US005752611A

United States Patent [19]

Nakagawa

[11] Patent Number: 5,752,611

[45] Date of Patent: May 19, 1998

[54] DISPLAY RACK

[76] Inventor: Curtis T. Nakagawa, 15409 Berendo Ave., Gardena, Calif. 90247

[21] Appl. No.: 743,493

[22] Filed: Nov. 4, 1996

[51] Int. Cl.[6] ..... A47B 47/00

[52] U.S. Cl. ..... 211/186; 211/203

[58] Field of Search ..... 211/186, 189, 211/128, 203, 195

[56] References Cited

U.S. PATENT DOCUMENTS

| | | | |
|---|---|---|---|
| 311,408 | 1/1885 | Butcher | 211/186 X |
| 900,331 | 10/1908 | Weston | 211/186 X |
| 1,787,982 | 1/1931 | Hess | 211/186 |
| 1,989,849 | 2/1935 | Davies | 211/186 X |
| 2,157,400 | 5/1939 | Cooper | 211/186 X |
| 2,335,301 | 11/1943 | Oidtmann | 211/186 X |

FOREIGN PATENT DOCUMENTS

| | | | |
|---|---|---|---|
| 56711 | 10/1952 | France | 211/186 |
| 836284 | 7/1949 | Germany | 211/186 |

*Primary Examiner*—Blair Johnson
*Attorney, Agent, or Firm*—Allan M. Shapiro

[57] ABSTRACT

The display rack has at least two substantially horizontal display shelves, each having at least three support openings. Uprights equal to the number of support openings are joined at an apex and extend down through the support openings to be secured on the bottom display shelf. Spacers surround the uprights between display shelves to hold the display shelves in position.

16 Claims, 2 Drawing Sheets

46
40
50

50
26
46
40
14
24
12
34
5
5
16
54
26
30
28
52
42

50
3
4
3
4
40
46
48
26
56
60
38
58

12
10
54
44
52
42
50
40
48
38

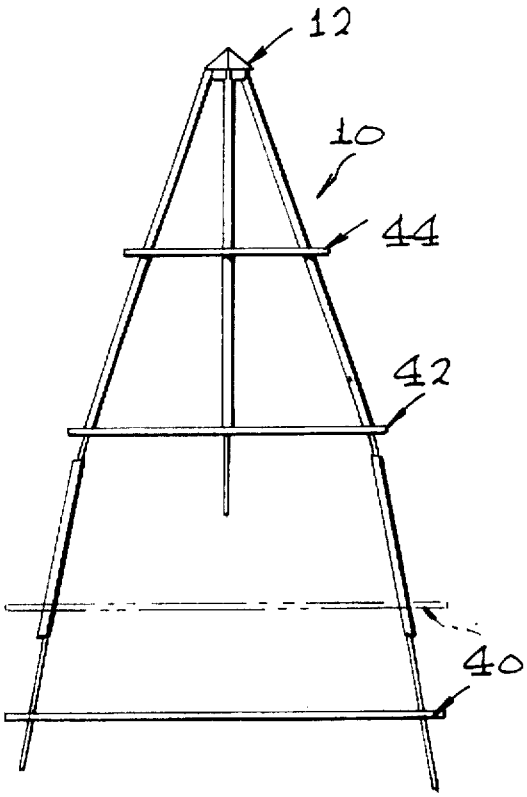
FIG. 6
FIG. 7
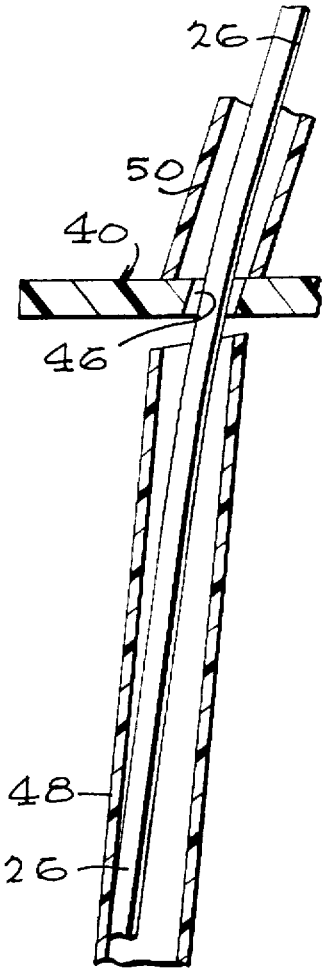
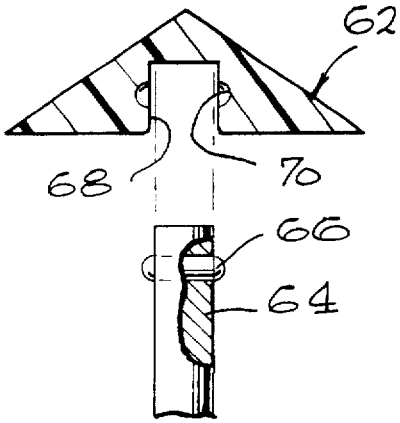
FIG. 8
FIG. 5
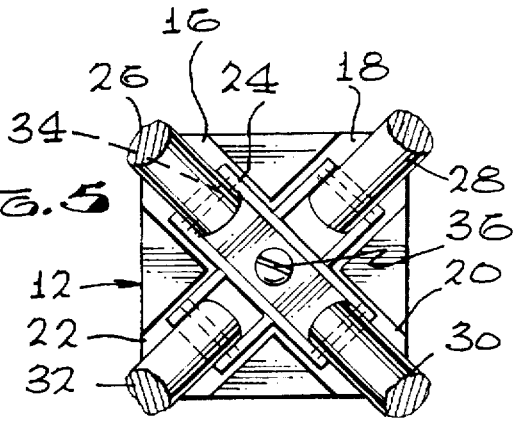

DISPLAY RACK

FIELD OF THE INVENTION

This invention is directed to a display rack for displaying articles on several shelves, which display rack can be compactly stored and conveniently erected.

BACKGROUND OF THE INVENTION

There are many situations in which there is a requirement for a rack to attractively display one or more items. However, the display rack must also be compactly storable for those periods when it is not in use. When it is desired to be used, the display rack must be easily assemblable. When assembled, the display rack must be attractive so that it can enhance the appearance of the displayed items. Thus, the creation of a display rack of significant merit requires considerable creativity.

SUMMARY OF THE INVENTION

In order to aid in the understanding of this invention, it can be stated in essentially summary form that it is directed to a display rack which has at least two substantially horizontal display shelves, each having at least three support openings. Uprights equal to the number of support openings are joined at an apex and extend down through the support openings to be secured on the bottom display shelf. Spacers surround the uprights between display shelves to hold the display shelves in position.

It is thus a purpose and advantage of this invention to provide an attractive display rack which can be compactly stored and which can be easily erected into an attractive display rack.

It is another purpose and advantage of this invention to provide a demountable display rack which is compact when disassembled and which can be assembled in a minimum time by unskilled workers to result in a strong display rack.

It is a further purpose and advantage of this invention to provide a display rack which can be economically constructed so that it can be widlely used.

The features of the present invention which are believed to be novel are set forth with particularity in the appended claims. The present invention, both as to its organization and manner of operation, together with further objects and advantages thereof, may be best understood by reference to the following description.

BRIEF DESCRIPTION OF THE DRAWINGS

FIG. 5 is an enlarged section taken generally along the line 5—5 of FIG. 2, showing the under side of the apex member.

FIG. 6 is a side-elevational view of the display rack during assembly showing the flexure of the upright members.

FIG. 7 is an enlarged view of a portion of the structure of FIG. 6, with parts broken away and parts taken in section.

FIG. 8 is a section through another embodiment of the apex member.

DESCRIPTION OF THE PREFERRED EMBODIMENTS

Figures 1, 2, 3, 4:
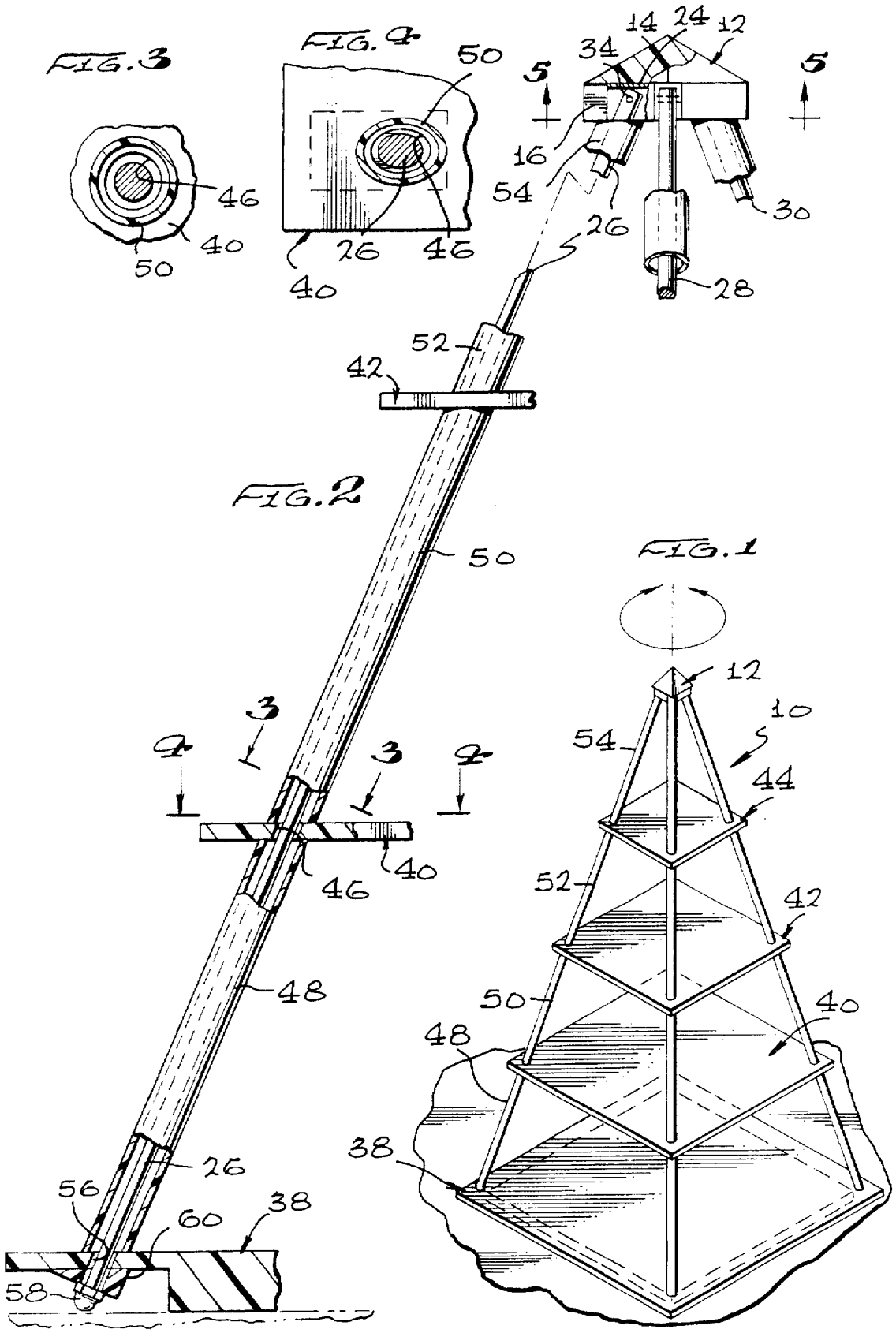
FIG. 1 is an isometric view of the display rack of this invention in its assembled condition.
FIG. 2 is an enlarged view of one corner of the display rack, with parts broken away and parts taken in section.
FIG. 3 is an enlarged section taken generally along line 3—3 of FIG. 2.
FIG. 4 is an enlarged section taken generally along line 4—4 of FIG. 2.

The preferred embodiment of the display rack of this invention is generally indicated at 10 in FIGS. 1 and 6. The display rack is shown in its preferred embodiment wherein the shelves are square and there are four upright members adjacent the corners of the square shelves. FIGS. 1 and 6 show the apex member 12 at the top of the display rack 10, and FIGS. 2 and 5 show the apex member in more detail. The apex member has a pyramidal top surface 14. As seen in FIG. 5, the apex member is square. As seen in FIG. 2, the apex member has four recesses 16, 18, 20 and 22 on the underside. These recesses may be formed as a pair of intersecting slots oriented toward the corners of the apex. Interiorly of the recesses is positioned bracket 24. The bracket is channel-shaped in each of the recess directions. Upright members 26, 28, 30 and 32 lie within the channel-shaped sides of the bracket in the respective recesses. The upright members are pivotally pinned in the channel-shaped bracket. Pivot pin 34 is shown in full lines and end view in FIG. 2 and is shown in dashed lines in FIG. 5. As seen in FIG. 5, each of the upright members is pivotally mounted on its own pivot pin in the arms of the channel-shaped bracket 24. The bracket 24 is secured into the apex member by any convenient means, such as by screw 36. This pivotal structure permits the upright members to swing together and lie next to each other when unrestrained. This is the storage position. The upright members are preferably solid rods made of sufficiently small diameter of sufficiently elastic material so as to be somewhat flexible. Hard-drawn anodized aluminum alloy rods are suitable. As is seen below, these rods will be visible, and a bright rod such as one that is shiny and laquered is considered to enhance the appearance of the erected display rack.

In addition to its base 38, the display rack 10 is provided with first, second and third shelves 40, 42 and 44, which are seen in FIG. 1 in the assembled display rack. The base 38 and each of the shelves is square, and each has a hole in the corner back from the edges of the respective shelf. The hole 46 in the corner of first shelf 40 is seen in FIGS. 2, 3, 4 and 7. As is seen in FIGS. 2 and 3, the hole 46 is parallel to the upright member 26, which passes therethrough.

In the assembled display rack, spacers surround the uprights between the shelves and support the shelves in fixed positions above the base and with respect to each other. Considering only the upright 26, tubular spacers 48, 50, 52 and 54 embrace the upright member 26 respectively above base 38, above first shelf 40, above second shelf 42, and above third shelf 44. The upper tubular spacer 54 engages against the bottom of the apex member. The spacers preferably hold the shelves at equal spicing. The tubular spacers are preferably transparent and are shown as circular tubes with substantially uniform wall thickness. The material is preferably rigid synthetic polymer composition material so as to have good compression strength to hold its circular tubular configuration under compressive stress. It is understood that additional spacers of the same configuration embrace each of the upright members between each of the shelves and against the base and apex member.

In the assembled condition, the base spreads the upright members so that their bottom ends are engaged through openings adjacent the corners of the base. Hole 56 is seen in FIG. 2. The base 38 is relieved at the corners, and the upright members extend therethrough and have securing nuts on the bottom. Securing nut 58 is shown attached to the bottom end of upright member 26 in the lower part of FIG. 2. Since the bottom ends of these upright members are spread apart by the size of the base as compared to the size of the apex member, the upright members are divergent. Thus, they pass at an acute angle through the shelves and the base. The holes are cut at the desired angle, as shown for holes 46 and 56. A tapered washer 60 is preferably employed above nut 58 to equalize loading. Similarly, the ends of the tubular spacers are cut at the same angle so that they engage evenly on the tops and bottoms of the shelves. As noted, the tubular spacers are preferably transparent so that the upright members are visible. It is seen that these upright members serve as tension members and, when the nuts in the bottom end thereof are tightened, the tubular spacers are compressed against the shelves. This holds the shelves firmly in place.

It can be appreciated that, when disassembled, the display rack can be conveniently arid compactly stored. The uprights can lie next to each other. The shelves can be stacked and bundled, and the tubular spacers can be bundled. Assembly is accomplished by putting the upper tubular spacer 54 and its companions on the four uprights. Next, the third shelf 44 is installed over the now free bottom ends of the uprights. Next, the next set of tubular spacers 52 is installed. However, the third shelf 44 is not thrust to its upper limit because this would spread the lower ends of the upright members too far for the installation of second shelf 44. When the third shelf 44 is moved partway up and the spacers 52 therebelow are in place, then the second shelf 42 is installed. Next comes the set of spacers 50, and both the shelves 44 and 42 are moved up on the uprights Next comes installation of the first shelf 44. It can be appreciated that it is difficult to keep the free lower ends of the upright members in the correct spacing to go through the holes adjacent the corners of the shelves. For this reason, it is desirable that the uprights be resilient, as described above. The uprights are resiliently bent, as shown in FIGS. 6 and 7, in order to insert the free ends of the uprights through the corresponding holes. Finally, the lowest set 48 of tubular spacers is put in place, and the free ends of the uprights are inserted through the holes in the base. Thereupon, the tapered washers 60 and nuts 58 are put in place. Tightening of the bottom nuts tensions the upright members and compresses the spacers to make the assembled display rack rigid.

It can be appreciated that the display rack can be created with more or less upright members than the four illustrated, although three is the minimum number for an independent and stable display rack. Furthermore, the shelves need not be equally spaced as long as the spacing between the corner holes is related to the length of the spacers between shelves to permit the upright members to be straight when the structure is assembled.

FIG. 8 illustrates apex member 62, which is the second preferred embodiment of the apex member. Upright 64 has spring-loaded bullet-nose detents 56 extending out of the sides adjacent its upper end. This configuration is matched by an opening 68, which receives the upper end of upright 64 and detent openings 70, which receive the detent 66. Thus, the upright can be snapped into and removed from the apex member 62. It will be appreciated that there is an equal number of openings 68 to the number of uprights, and each upright is so equipped. The openings 68 are divergent at the same angle as the divergence of the upright members when the display rack is in the assembled condition. In this way, a sturdy and attractive display rack is created. The display rack may be disassembled for shipping and storage and may be readily assembled for use.

This invention has been described in its presently contemplated best modes, and it is clear that it is susceptible to numerous modifications modes and embodiments within the ability of those skilled in the art and without the exercise of the inventive faculty. Accordingly, the scope of this invention is defined by the scope of the following claims.

What is claimed is:

1. A display rack comprising:

a pyramidal apex member;

at least three upright members mounted in said apex member, said upright members being pivotally mounted in said apex member to swing from a divergent downward orientation with respect to each other when said display rack is assembled to a position wherein said upright members are substantially parallel and close to each other in a shelf demounted position;

a base, said base being larger than said apex member, said base having a plurality of holes therein including one hole for each of said upright members, said holes being positioned so that when said apex members respectively extend through their holes in said base, said upright members are divergent in the downward direction;

at least one shelf positioned between said base and said apex member, said shelf having holes therethrough and said upright members extending through said holes in said shelf, said shelves being flat including around said holes for said upright members, said upright members being sufficiently resiliently flexible to permit assembly of said at least one shelf thereon, said upright members being detachable from said base so that said base and said at least one shelf can be removed from said upright members to permit demounting of said display rack for storage; and a plurality of tubular spacers, said tubular spacers being positioned to surround said upright members between said base and said shelf and between said shelf and said apex member so that said upright members can be tensioned to place said tubular spacers in compression so that said display rack forms a pyramidal rigid structure.

2. The display rack of claim 1 wherein said tubular spacers are substantially transparent so that said upright members can be seen therethrough.

3. The display rack of claim 1 wherein said tubular spacers are all of the same length and shape so that upon assembly, any of said tubular spacers can be assembled in any spacer position.

4. The display rack of claim 1 wherein said openings for said upright members through said at least one shelf and through said base are at an acute angle with respect to the surface of said shelf and the surface of said base so as to lie substantially parallel to said upright members when said upright members are positioned therethrough.

5. The display rack of claim 1 wherein there are at least two shelves and there are at least four upright members.

6. A display rack comprising:

a pyramidal apex member and a base, said apex member being smaller than said base;

at least three, resilient upright members;

fastening means in said apex member for movably mounting said at least three upright members close to each other to said apex member and fastening means in said base for detachably attaching said at least three upright members to said base further apart than at said pyramidal apex member, said fastening means being positioned so that upright members attached to said fastening means in said apex member and to said fastening means in said base are divergent in a direction from said apex member to said base;

at least three flexible upright members pivotally attached to said fastening means in said apex member and detachably attached to said fastening means in said base;

at least first and second flat shelves between said apex member and said base, a hole through said shelves for each of said upright members, said upright members extending through said holes in said shelves when said display rack is assembled, said upright members being sufficiently flexible to be able to bend to pass through said openings in said second shelf when said first shelf is already in place; and a tubular spacer surrounding each said upright member above and below each said shelf, each said tubular spacer being of the same length and configuration so that any one of said tubular spacers can serve as a compression member in any location and said upright members serve as tension members to hold said display rack in a rigid erected position.

7. The display rack of claim 6 wherein said fastening means in said apex member for mounting of upright members thereto comprises a pivot pin for each said upright member mounted in said apex member and extending through said upright member.

8. The display rack of claim 6 wherein said apex member has an upright member recess therein for each said upright member and each said upright member extends into a separate one of said recesses, and there is a detent interengaging each said upright member with said apex member so that each said upright member is detachably retained in its recess.

9. The display rack of claim 6 wherein there are at least three shelves between said apex member and said base and there is a tubular spacer or each said upright member between said shelves.

10. The display rack of claim 6 wherein said holes through said shelves for passing said upright members are at an acute angle through said shelves so as to be substantially parallel to said upright members.

11. The display rack of claim 10 wherein said upright members are metallic.

12. The display rack of claim 11 wherein said tubular spacers are transparent so that said metallic upright members can be seen.

13. The display rack of claim 10 wherein said tubular spacers are formed at an acute angle at each end so that said ends of said tubular spacers lie substantially flat against said shelves on said divergent upright members.

14. The display rack of claim 13 wherein said upright members are metallic.

15. The display rack of claim 10 wherein said fastening means in said apex member for mounting of upright members thereto comprises a pivot pin for each said upright member mounted in said apex member and extending through said upright member.

16. The display rack of claim 10 wherein said apex member has an upright member recess therein for each said upright member and each said upright member extends into a separate one of said recesses, and there is a detent interengaging each said upright member with said apex member so that each said upright member is detachably retained in its recess.

* * * * *